United States Patent [19]

Piazzetta

[11] 4,436,079

[45] Mar. 13, 1984

[54] FIREPLACE FOR HEATING INDOOR SPACES AND WATER FOR SANITARY USE

[76] Inventor: Domenico Piazzetta, Via Montello, 23-Casella D'Asolo-(Provincia di Treviso, Italy

[21] Appl. No.: 273,554

[22] Filed: Jun. 15, 1981

[30] Foreign Application Priority Data

Jun. 25, 1980 [IT] Italy ..... 41596 A/80

[51] Int. Cl.[3] ..... F24B 7/00

[52] U.S. Cl. ..... 126/121; 126/131; 126/132; 237/1 SL; 237/56; 237/51

[58] Field of Search ..... 126/121, 131, 132, 101, 126/34; 237/1 SL, 8 R, 51, 56, 63

[56] References Cited

U.S. PATENT DOCUMENTS

| | | | |
|---|---|---|---|
| 1,467,474 | 9/1923 | Day | 237/56 |
| 1,895,503 | 1/1933 | Will | 237/1 SL |
| 2,231,258 | 2/1941 | Elmore | 126/121 |
| 2,277,381 | 3/1942 | Black | 237/51 |
| 4,046,320 | 9/1977 | Johnson et al. | 237/8 C |

*Primary Examiner*—Lee E. Barrett

*Attorney, Agent, or Firm*—Guido Modiano; Albert Josif

[57] ABSTRACT

An improved fireplace for heating indoor spaces and sanitary water comprises a hearth whereon wood can be burned such as to define a heat source, and, adjacent the hearth, an air circulating space and a sanitary hot water generating heat exchanger.

1 Claim, 2 Drawing Figures

FIREPLACE FOR HEATING INDOOR SPACES AND WATER FOR SANITARY USE

BACKGROUND OF THE INVENTION

This invention relates to an improved fireplace for heating indoor spaces and water for sanitary use.

In view of the growing demand for more efficient and energy-saving heating systems, particularly for small residential applications, the Applicant has devised a way of exploiting traditional wood-burning fireplaces to effectively supply heat to plural indoor spaces.

A major problem encountered with such alternative heat sources to conventional central heating systems is that of taking the heat generated out of the space or room where the fireplace is located.

A further problem is that, where the fireplace happens to be the sole source of heat in a house, then no hot water be made available on a continuous basis for sanitary use.

SUMMARY OF THE INVENTION

It is a primary object of this invention to provide an improved fireplace which is capable of supplying heat to more than one room as well as hot water for general convenience.

A further object of the invention is to provide a fireplace, whereby hot water can be produced continuously for sanitary purposes.

It is another object of this invention to provide a fireplace which can be operated efficiently without any risk of dangerous situations arising such as the fluid in the heat dispensing system reaching the boiling point.

Yet another object is to provide such a fireplace, which is made up of simple component parts requiring no special maintenance and being of relatively small cost.

These and other objects, such as will be apparent hereinafter, are achieved by an improved fireplace for heating indoor spaces and water for sanitary use, comprising a hearth whereon wood is burned such as to define a heat source, characterized in that it further comprises, adjacent said hearth, an interspace for circulating air and a heat exchanger wherethrough a liquid is caused to flow, said heat exchanger being operative to generate hot water for sanitary purposes, means being also provided for replacing or assisting said heat source.

BRIEF DESCRIPTION OF THE DRAWINGS

Further features and advantages of the invention will be more clearly understood from the following detailed description of a preferred, though not limitative, embodiment thereof, given herein by way of example and not of limitation and illustrated in the accompanying drawings, where.

DESCRIPTION OF THE PREFERRED EMBODIMENTS

Figure 1:
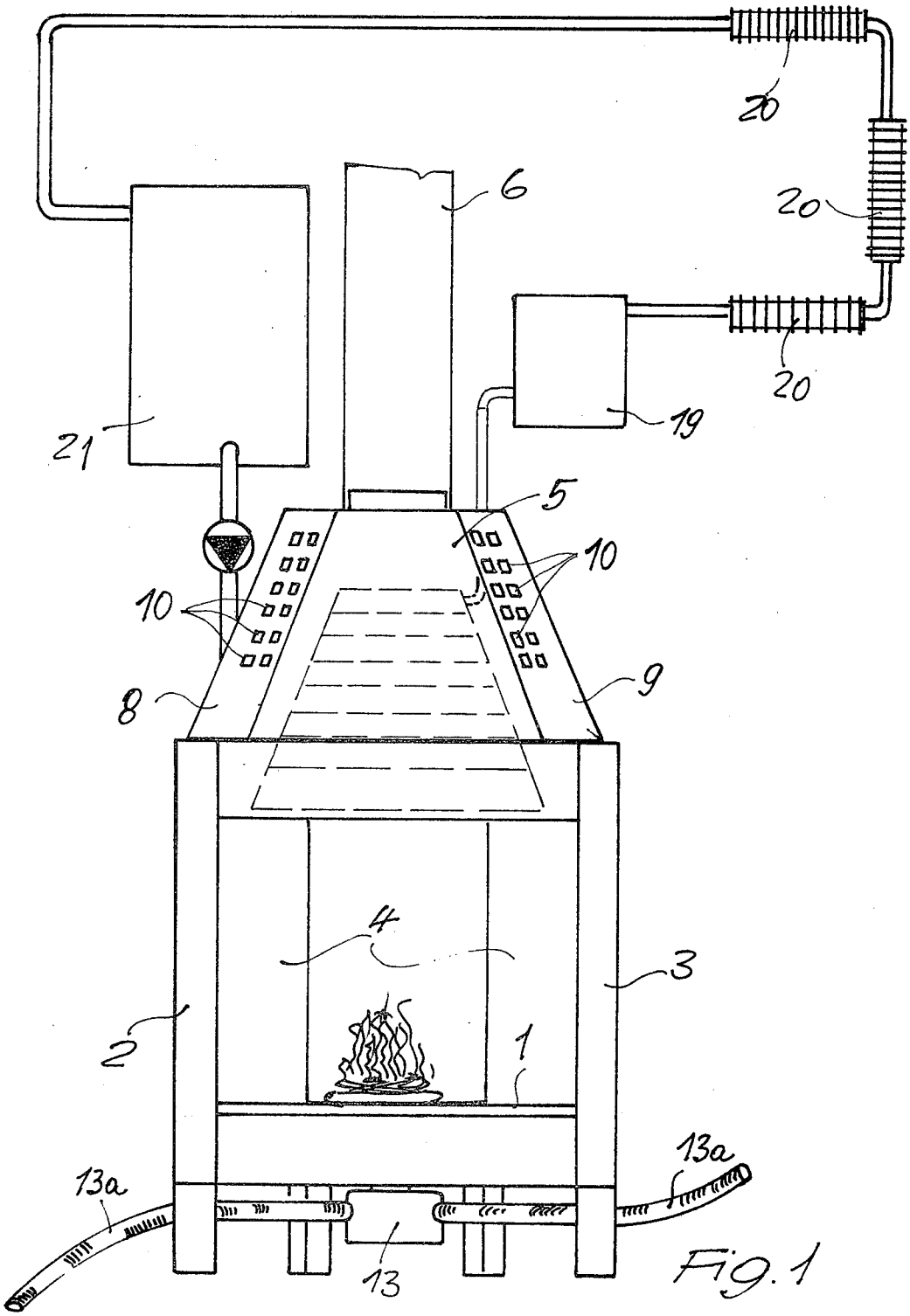
FIG. 1 is a front view of the fireplace, with a diagramatical representation of the circuits and devices connected thereto.
Figure 2:
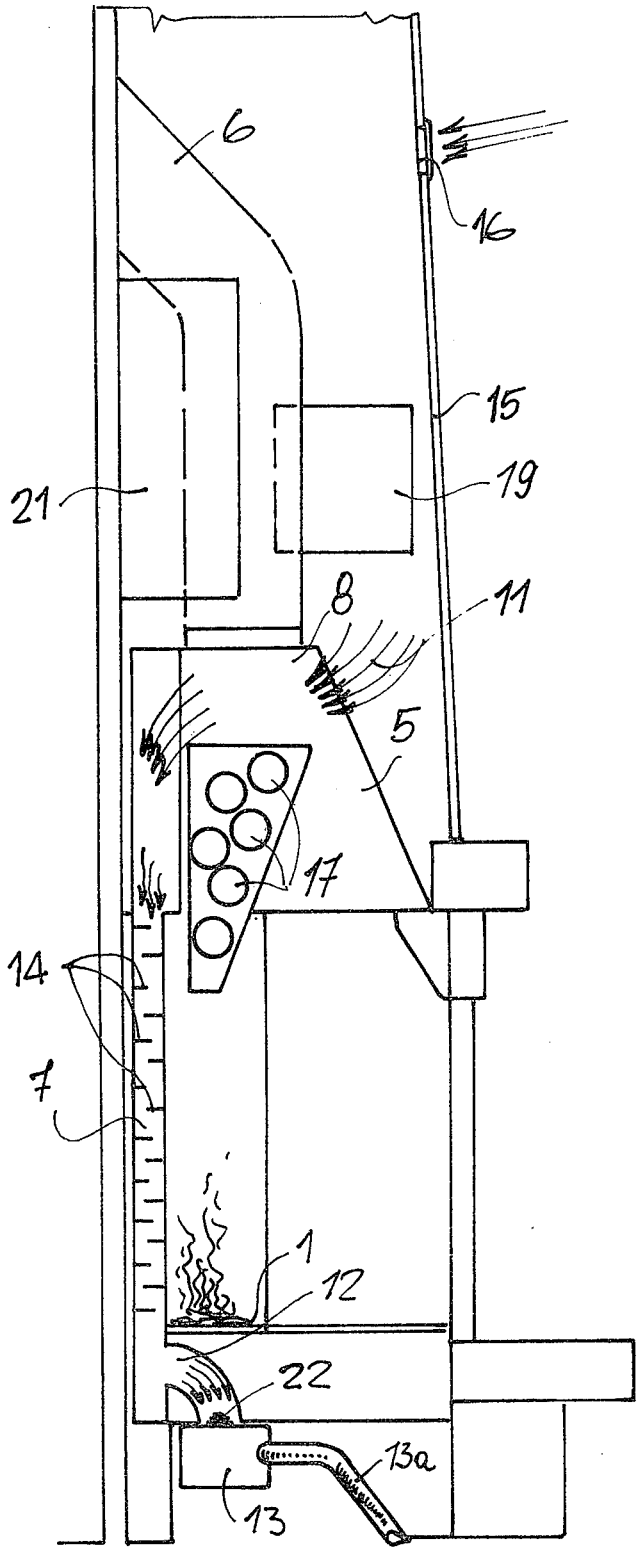
FIG. 2 is a sectional side view of the fireplace according to the invention.

With reference to the drawing figures, this fireplace comprises a hearth 1 bordered on its sides by two walls 2 and 3, closed on the rear by a partition 4, overlaid by a hood 5 which extends into a flue 6.

On the rear of said partition 4, there is formed an interspace 7 which is further extended into two compartments 8 and 9 laid on the sides of said hood 5, and being provided on the front face with a plurality of holes 10 intended to allow air to flow in the directions of the arrows 11.

At the bottom, said interspace 7 directs air into a duct 12 which constitutes the inlet end of a suction fan 13 operative to deliver the air into ducts **13*a*** which may lead into different rooms.

In order to improve the efficiency of the thermal exchange in said interspace 7, alternately arranged sects or partitions 14 are provided which, in addition to lengthen the airflow travel distance, also considerably increase the surface areas of thermal exchange. Air is drawn in from above, and if the fireplace is provided with a decorative screen 15 for the hood 5 and flue 6, ports 16 will be provided at the upper region near the ceiling to allow the airflow therethrough.

In actual practice, the air drawn in from the upper regions of the rooms (virtually ceiling-mounted ports being optionally provided along with their related ducting to draw air from a number of rooms), is forced to flow down the sides of the hood 5 and then into the interspace 7, where it is heated prior to being delivered to the various rooms.

The upper inner portion of the hood 5 accommodates a tube nest heat exchanger 17 which is swept by the hot combustion gases and has a fluid being circulated therethrough by a small pump 18, said fluid being in this case a diathermal or diathermic oil.

The heat exchanger 17 is included in a circuit which also comprises a small gas-fired boiler 19 serving as a thermal assist device or alternative heat source, as well as radiator elements 20 which are variously located in the rooms, and a water heater 21 wherein hot water is generated for sanitary purposes. All such ancillary components are conveniently arranged behind the screen 15.

As an additional assist, an electric resistance heater 22 is provided in the duct 12 to heat air in the event that hot air is required while the flame in the fireplace is extinguished.

As visible from the drawing the screen 15 defines a screened space enclosing the hood 5, the flue 6, the boiler 19, the water heater 21, the pump 18

The inventive system operates in the following manner:

(a) Wood-burning mode:

The heat generated by the combustion of wood on the hearth of the fireplace is delivered to the air being force-circulated through the interspace, thus heating it. The heated air is supplied, through a plurality of ducts, in various directions to the room or to the various rooms which require to be heated.

(b) Electric mode:

When it is not desired to burn wood in the fireplace, the electric resistance heater located in the proximity of the suction fan may be energized. Also in this case, the heated air is conveyed to the rooms to be heated.

(c) Hot water for sanitary purposes generation mode:

The diathermal oil which is circulated through the system is heated in the heat exchanger and may reach much higher temperatures than the water boiling point without any trouble. Thus, the oil will deliver its stored heat to the water in a conventional water heater.

(d) Gas-firing mode:

With the fireplace extinguished, the gas-fired boiler may be operated, thus heating both the rooms and sanitary water. The small gas-fired boiler may be conveniently included as an assist device when the fireplace is only operated for slow combustion.

It will be appreciated from the foregoing description and illustration that the invention achieves its objects. In particular, it will be appreciated that the invention provides a diversified heat energy operated compact fireplace.

Of course, the relative arrangements, dimensions, and the materials employed may be any ones to suit individual requirements.

I claim:

1. A diversified heat energy operated compact fireplace comprising a hearth, lateral walls bordering said hearth on its sides, a partition on the rear of the hearth, a hood overlying the hearth and a flue into which said hood extends, at the rear of said partition an interspace defined by said partition, two compartments extending on the sides of said hood and communicating with said interspace, said compartments having each a front face with a plurality of holes in said front faces for allowing air to flow therethrough, a screen extending in front of the hood and the flue to define a screened space behind said screen, said screened space enclosing said hood and said flue, ports in said screen at the upper region thereof to allow passage of air therethrough, a tube nest heat exchanger in the upper inner portion of said hood, said heat exchanger being exposed in use to combustion gases from the hearth, hydraulic circuit means for said heat exchanger, said hydraulic circuit means including a pump within said screened space for circulating heat exchanging oil through said heat exchanger, a gas-fired boiler in said hydraulic circuit means and arranged in said screened space, said gas-fired boiler providing a first diversified heat energy source for said fireplace, a water heater included in said hydraulic circuit and located in said screened space for providing hot water for sanitary purposes and radiator elements connected with said hydraulic circuit, duct means connected with the lower part of said interspace, a fan located below said hearth and in communication with said duct means to draw in use air from said interspace and thereby create in use a current of air entering said ports of the screen from the indoor space and flowing downwards through said screened space towards said holes in said compartments and through said hole into said compartments and therefrom into said interspace, said fan having delivery ducts leading into the indoor space to be heated, said duct means connected with the bottom of said interspace including an electric resistance heater for heating in use the air drawn by said fan, said heater providing a second diversified heat energy source.

* * * * *